US006888429B2

(12) United States Patent
Okajima et al.

(10) Patent No.: US 6,888,429 B2
(45) Date of Patent: May 3, 2005

(54) TRANSMISSION LINE WITH A PROJECTING DIELECTRIC PART HAVING AN OPPOSING COPLANAR LINE AND TRANSCEIVER

(75) Inventors: Shingo Okajima, Ishikawa-ken (JP); Toshiro Hiratsuka, Machida (JP); Takeshi Okano, Yokohama (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 176 days.

(21) Appl. No.: 10/309,307

(22) Filed: Dec. 3, 2002

(65) Prior Publication Data

US 2003/0117245 A1 Jun. 26, 2003

(30) Foreign Application Priority Data

Dec. 4, 2001 (JP) ..... 2001-370333

(51) Int. Cl.[7] ..... H01P 3/16
(52) U.S. Cl. ..... 333/250; 333/33
(58) Field of Search ..... 333/239, 250, 333/26, 33

(56) References Cited

U.S. PATENT DOCUMENTS 5,872,485 A * 2/1999 Ishikawa et al. ..... 333/250 X
6,614,332 B2 * 9/2003 Yamashita et al. ..... 333/239

FOREIGN PATENT DOCUMENTS

| | | |
|---|---|---|
| EP | 0 883 328 A1 | 12/1998 |
| JP | 8-265007 | 10/1996 |
| JP | 2001-196301 | 7/2000 |

OTHER PUBLICATIONS

Lucian Gruner, IEEE Transactions on Microwave Theory and Techniques, vol. 40, No. 5, pp. 995–999 (1992).
Deslandes et al., "Integrated Transition of Coplanar to Rectangular Waveguides", IEEE MTT–S Digest, pp. 619–622 (2001).
"Transmission Line Modeling of CPW–Slotline Transitions and CPW Butterfly Filters"; Chien–Hsun Ho, et al.; 1994 IEEE MTT–S Digest; pp. 1305–1308.
"Experimental Investigations of CPW–Slotline Transitions for Uniplanar Microwave Integrated Circuits"; Chien–Hsun Ho, et al.; 1993 IEEE MTT–S Digest; pp. 877–880.
"Coplanar Waveguide Transitions to Slotline: Design and Miroprobe Characterization"; Wes Grammer, et al.; IEEE Transactions on Microwave Theory and Techniques; vol. 41, No. 9; Sep. 1993; pp. 1653–1658.
"A New Coplanar Waveguide/Slotline Double–Balanced Mixer"; David Cahana; 1989 IEEE MTT–S Digest; pp. 967–968.

* cited by examiner

*Primary Examiner*—Benny Lee
(74) *Attorney, Agent, or Firm*—Dickstein, Shapiro, Morin & Oshinsky, LLP

(57) ABSTRACT

A projecting part is formed on the bottom surface of a dielectric substrate and a first conductive layer and a second conductive layer are respectively formed on the top surface and the bottom surface of the dielectric substrate. A plurality of through holes are formed along the left and the right of the projecting part. A coplanar line including a center electrode sandwiched between two grooves is provided on the top surface. Two slots connected to the top end of the coplanar line are formed at a position corresponding to the position of the projecting part, whereby a waveguide formed by the projecting part and the coplanar line are interconnected via the slots.

20 Claims, 21 Drawing Sheets

TRANSMISSION LINE WITH A PROJECTING DIELECTRIC PART HAVING AN OPPOSING COPLANAR LINE AND TRANSCEIVER

BACKGROUND OF THE INVENTION

1. Field of the Invention

The present invention relates to a transmission line for transmitting RF signals such as microwave signals and EHF signals. Further, the present invention relates to a transceiver including the transmission line, such as a radar system and a communication device.

2. Description of the Related Art

Generally, a waveguide transmission line using a dielectric substrate includes, for example, two rows of through holes formed on the dielectric substrate for connecting two or more conductive layers formed on the dielectric substrate (as disclosed in Japanese Unexamined Patent Application Publication No. 2000-196301 or the like). Further, such a transmission line includes a coupler formed by making an opening in the conductive layer on the top surface of the dielectric substrate and a square waveguide that is formed around the coupler and is connected to the coupler. In such a case, a waveguide is formed between the two rows of through holes. Further, the waveguide in the dielectric substrate and the square waveguide are connected via the coupler.

In the above-described case, only the through holes are used as current paths formed along a direction perpendicular to the waveguide (the thickness direction of the dielectric substrate). Therefore, as RF signals are propagated, a flowing current is concentrated into the through holes. Subsequently, the conductor loss is increased as the current density in the through holes is increased.

Further, if a semiconductor element such as a Microwave Monolithic Integrated Circuit (MMIC) were mounted on the top surface of the dielectric substrate, the connectivity between the semiconductor element and the above-described waveguide and square waveguide would be low. Therefore, the losses at connection points would be large.

SUMMARY OF THE INVENTION

Accordingly, it is an object of the present invention to provide a transmission line and a transceiver. The transmission line can reduce the conductor loss thereof. Further, the transmission line can be easily connected to a semiconductor element.

For solving the above-described problems, the transmission line comprises a dielectric substrate and a projecting part that has protruding cross section and that extends along an RF-signal transmission direction on the bottom surface of the dielectric substrate. The transmission line further comprises a first conductive layer formed on the top surface of the dielectric substrate and a second conductive layer formed on the bottom surface of the dielectric substrate. The bottom surface includes the outer surfaces of the projecting part. Further, a plurality of through holes are formed on both sides of the projecting part. The through holes penetrate the dielectric substrate and connect the first and second conductive layers. Further, the transmission line comprises a coplanar line including two grooves that extend in parallel with each other and that cut through the first conductive layer on the top surface. The coplanar line further includes a center electrode sandwiched between the two grooves. The transmission line further comprises two slots formed as openings on the top surface at a position corresponding to that of the projecting part on the bottom surface. The two slots are each connected to the corresponding grooves of the coplanar line.

In the above-described case, a waveguide is formed along the projecting part. Subsequently, RF signals in the waveguide are guided to the grooves of the coplanar line via the slots. Therefore, the RF signals can be efficiently converted between the waveguide in the dielectric substrate and the coplanar line. Further, as a current can flow on the outer surfaces of the projecting part, the amount of the flowing current that is concentrated into the through holes is reduced. Further, the propagation loss of the RF signals in the transmission line can be reduced.

Preferably, the transmission line further comprises a stub with a short-circuited terminal end. The stub may branch off and extend from each of the grooves of the coplanar line.

Subsequently, it becomes possible to bring the impedance of the coplanar line close to the impedance of the slots. Therefore, the reflection between the slots and the coplanar line is reduced and the RF signals can be efficiently converted between the coplanar line and the slots.

Preferably, the transmission line further comprises a stub with an open circuit end. The stub may branch off and extend from each of the grooves of the coplanar line.

Preferably, the stubs are fan-shaped. Subsequently, the RF signals can be efficiently converted between the waveguide in the dielectric substrate and the coplanar line over a wide frequency band.

Preferably, the slots are fan-shaped.

Preferably, a semiconductor element is formed on the top surface of the dielectric substrate. The semiconductor element may be connected to the coplanar line.

In such a case, the coplanar line has the center electrode thereof functioning as a line conductor on the top surface of the dielectric substrate. The conductive layer on the top surface functions as a ground conductor. Subsequently, it becomes possible to connect the semiconductor element to the coplanar line on the surface of the dielectric substrate. Therefore, the semiconductor element can be easily mounted on the dielectric substrate.

A transceiver is formed using the transmission line of the present invention.

DESCRIPTION OF THE PREFERRED EMBODIMENTS

Transmission lines according to first to fourth embodiments of the present invention will now be described with reference to the drawings.

FIGS. 1 to 5 illustrate the transmission line according to the first embodiment of the present invention. The transmission line includes a dielectric substrate 1 comprising a resin material, a ceramic material, or the like. The dielectric substrate 1 preferably has a flat shape and has a relative dielectric constant ($\epsilon r$) of about 7.0 and a thickness H1 (FIG. 4) of about 0.3 mm. On a top surface 1A (FIGS. 1–4) of the dielectric substrate 1, a coplanar line 6 (FIGS. 1, 2, 3, and 5) is formed. On a bottom surface 1B (FIGS. 1, 3, 4) of the dielectric substrate 1, a projecting part 2 (FIGS. 1–4) is formed. The projecting part 2 has protruding cross section and extends along a direction along which RF signals, such as microwave signals and EHF signals, are transmitted (a direction represented by arrow A).

The lateral width W (FIG. 2) of the projecting part 2 is, for example, about 0.45 mm. The lateral width W is set, for example, so as to be smaller than $\lambda g/2$ in relation to the wavelength $\lambda g$ of an RF signal in the dielectric substrate 1.

Figure 1:
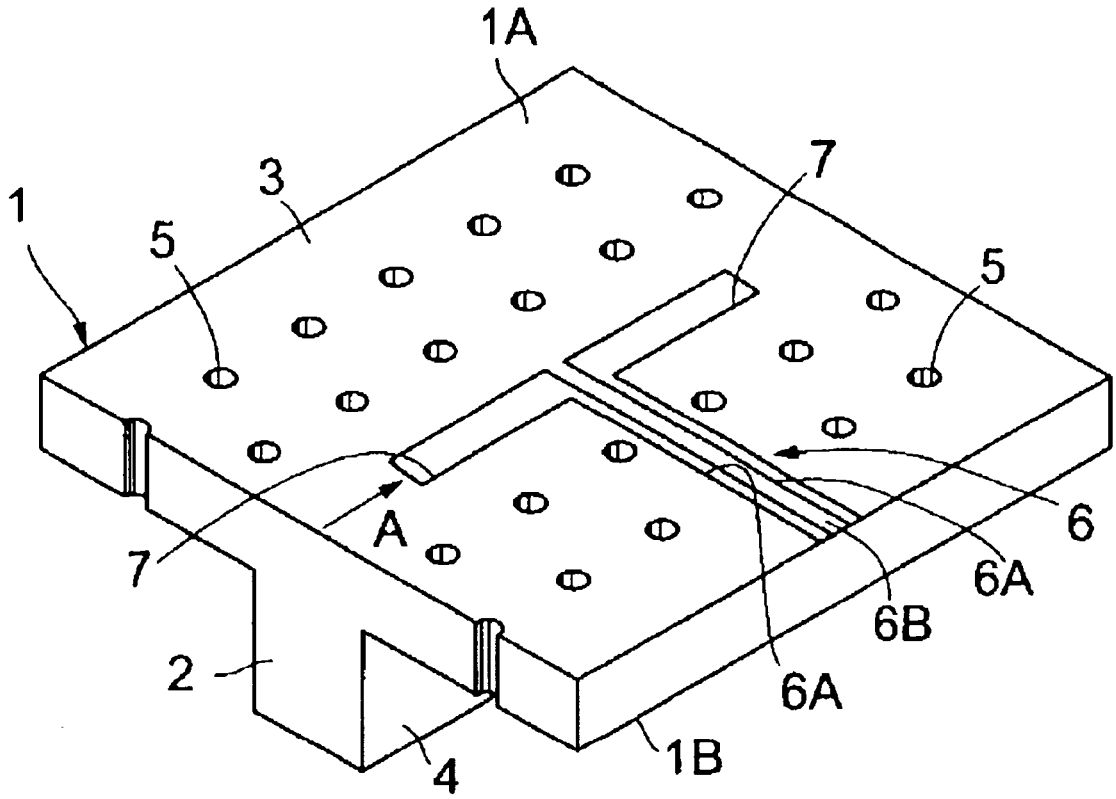
FIG. 1 is a perspective view of a transmission line according to a first embodiment.
Figure 2:
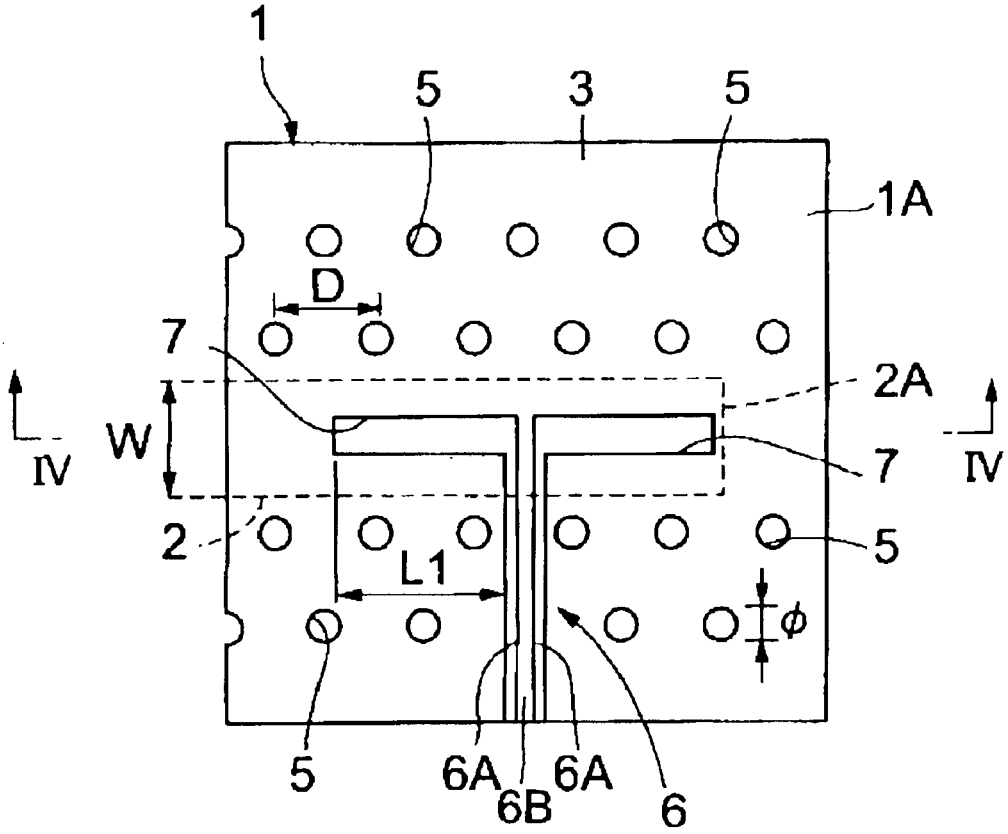
FIG. 2 is a plan view of the transmission line shown in FIG. 1.
Figure 3:
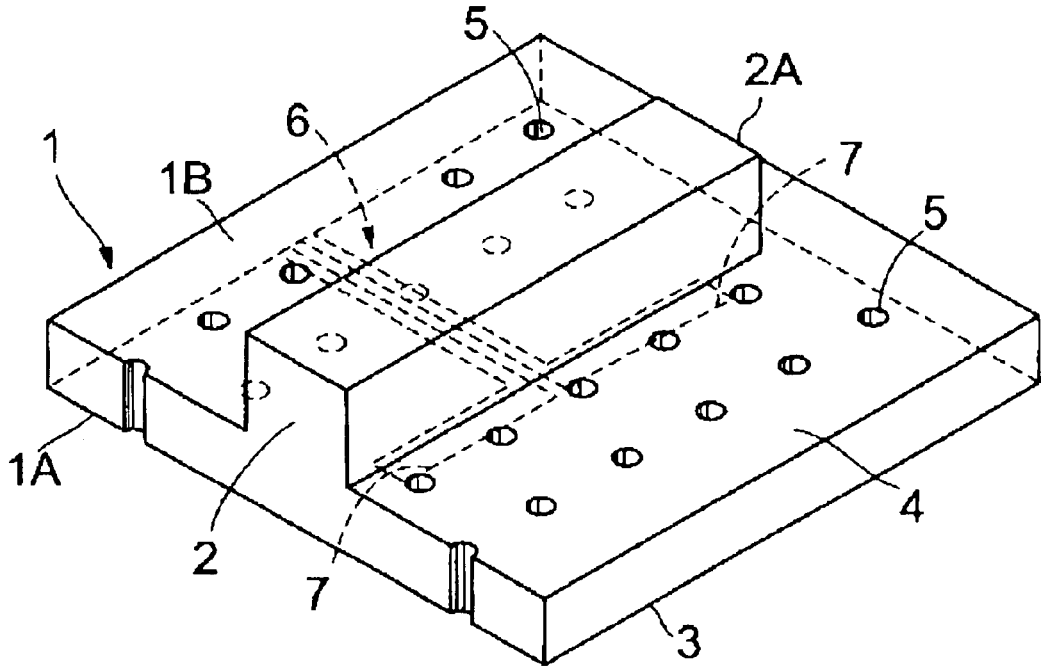
FIG. 3 is a perspective view of the bottom surface of the transmission line shown in FIG. 1.
Figure 4:
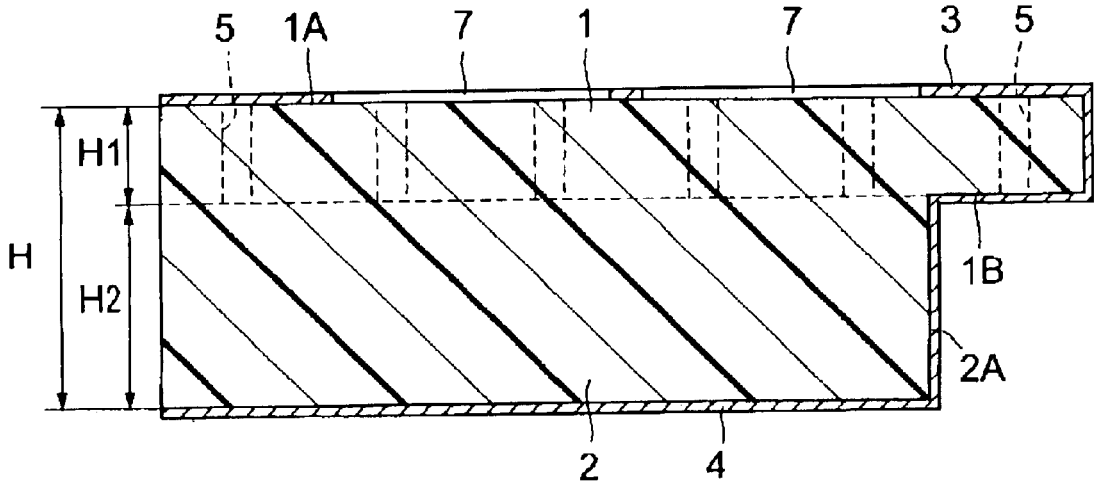
FIG. 4 shows an enlarged sectional view of the transmission line shown in FIG. 2 along line IV—IV.

Further, the projecting part 2 protrudes from the surface 1B of the dielectric substrate 1. The dimension of the projecting part 2 represented by H2 (FIG. 4) is, for example, about 0.6 mm. The thickness of the dielectric substrate 1 is represented by H1 (FIG. 4). Therefore, the height between the bottom surface of the projecting part 2 and the top surface 1A of the dielectric substrate 1 is represented by a height H (H=H1+H2). The height H (FIG. 4) is set so as to be larger than $\lambda g/2$ in relation to the wavelength $\lambda g$ of an RF signal in the dielectric substrate 1. Further, the projecting part 2 has a terminal end 2A (FIGS. 2, 3, 4) that constitutes a short-circuited position. The terminal end 2A is short-circuited by a conductive layer 4. (FIGS. 1, 3, 4). The details of the conductive layer 4 will be described later. The terminal end 2A is preferably provided near the center of the dielectric substrate 1.

Reference numerals 3 (FIGS. 1–4) and 4 represent a conductive layer formed on the top surface 1A and a conductive layer formed on the bottom surface 1B, respectively. Each of the conductive layers 3 and 4 preferably includes a conductive metal material and is formed into a thin film by a sputtering method, a vacuum evaporation method, or the like. Preferably, the conductive layer 4 substantially covers the entire bottom surface 1B, including the outer surfaces (the left and right side-surfaces, the bottom surface and the terminal-end surface 2A) of the projecting part 2.

Reference numerals 5 (FIG. 1–4) represent through holes that are provided at the left and right side-surfaces (both sides) of the projecting part 2. Also, the through holes 5 are provided along the direction along which the projecting part 2 extends. Each of the through holes 5 is preferably substantially circular in cross section, and has an internal diameter of about, for example, 0.1 mm. The through holes 5 are preferably formed by a laser, punching, or the like. Two rows of the through holes 5 are preferably provided along the RF-signal transmission direction (the direction represented by arrow A) at the left side-surface of the projecting part 2. Further, two rows of the through holes 5 are preferably provided along the RF-signal transmission direction (the direction represented by arrow A (FIG. 1) at the right side-surface of the projecting part 2. Therefore, four rows of the through holes 5 are preferably provided in parallel in the dielectric substrate 1. Furthermore, of the two rows of the through holes 5 at the left side-surface of the projecting part 2, the through holes 5 which are near the projecting part 2, and the through holes 5 which are farther from the projecting part 2 are preferably formed in a staggered arrangement along the direction of arrow A. Similarly, of the two rows of the through holes 5 at the right side-surface of the projecting part 2, the through holes 5 which are near the projecting part 2, and the through holes 5 which are far from the projecting part 2 are preferably formed in a staggered arrangement along the direction of arrow A. Each of the through holes 5 penetrates the dielectric substrate 1, and the wall surface thereof is covered by a conductive metal connected to the conductive layers 3 and 4. FIG. 2 shows a spacing D between the through holes 5 which are adjacent to one another so as to be parallel to the RF-signal transmission direction. The spacing D is preferably set so as to be smaller than $\lambda g/4$ in relation to the wavelength $\lambda g$ of the RF signal in the dielectric substrate 1.

Reference numeral 6 (FIGS. 1, 2, 3, 5) represents a coplanar line that is formed on the top surface 1A of the dielectric substrate 1. The coplanar line 6 preferably includes two grooves 6A (FIGS. 1, 2) that extend along and cut through the conductive layer 3 on the top surface 1A. Further, the coplanar line 6 preferably includes a band-shaped center electrode 6B (FIGS. 1, 2) provided in the gap between the grooves 6A. The center electrode 6B constitutes a line conductor for transmitting RF signals. The conductive layer 3, which surrounds the center electrode 6B, constitutes a ground conductor.

The width of the grooves 6A is set, for example, to about 0.03 mm, and the width of the center electrode 6B is set, for example, to about 0.1 mm. The coplanar line 6 extends, for example, in a direction orthogonal to the longitudinal direction of the projecting part 2. The top end of the coplanar line 6 reaches a position corresponding to the position of the projecting part 2. Since an electric field is formed in each of the grooves 6A, which are formed between the center electrode 6B and the conductive layer 3, the coplanar line 6 can transmit RF signals along the center electrode 6B.

Reference numerals 7 (FIGS. 1–5) represent two slots formed in the top surface 1A of the dielectric substrate 1. The slots 7 are preferably formed at the top end of the coplanar line 6. Each of the slots 7 is formed by making an opening in the conductive layer 3 on the top surface 1A. The base ends of the slots 7 are connected to the grooves 6A of the coplanar line 6. The slots 7 are preferably formed as substantially rectangular-shaped holes extending along the longitudinal direction of the projecting part 2 (the direction of arrow A). Further, the slots 7 preferably extend orthogonally to the coplanar line 6. The length of each slot 7 is represented by L1 (FIG. 2). L1 is preferably set to about $\lambda g/2$ in relation to the wavelength $\lambda g$ of the RF signal in the dielectric substrate 1. Preferably, both ends of the slots 7 in the longitudinal direction thereof are short-circuited ends.

The slots 7 are formed near the short-circuited position (the terminal end 2A) of the projecting part 2. The slots 7 connect a waveguide formed by the projecting part 2 and the through holes 5 to the coplanar line 6. Further, the slots 7 convert RF signals between the waveguide and the coplanar line 6.

Next, the operation of the transmission line will be described.

When an RF signal is input to the transmission line, the through holes 5, which are arranged as described above, equivalently form walls of the waveguide. Therefore, an electromagnetic wave (the RF signal) propagates in a mode corresponding to the TE10 mode. In this case, the two opposing side-surfaces of the projecting part 2 are designated as H surfaces. Further, the bottom surface of the projecting part 2 and the top surface 1A of the dielectric substrate 1 are designated as E surfaces. When the RF signal reaches the slots 7, the RF signal is guided to the grooves 6A of the coplanar line 6 via the slots 7. Then, the RF signal propagates in the coplanar line 6 along the center electrode 6B.

Figure 5:
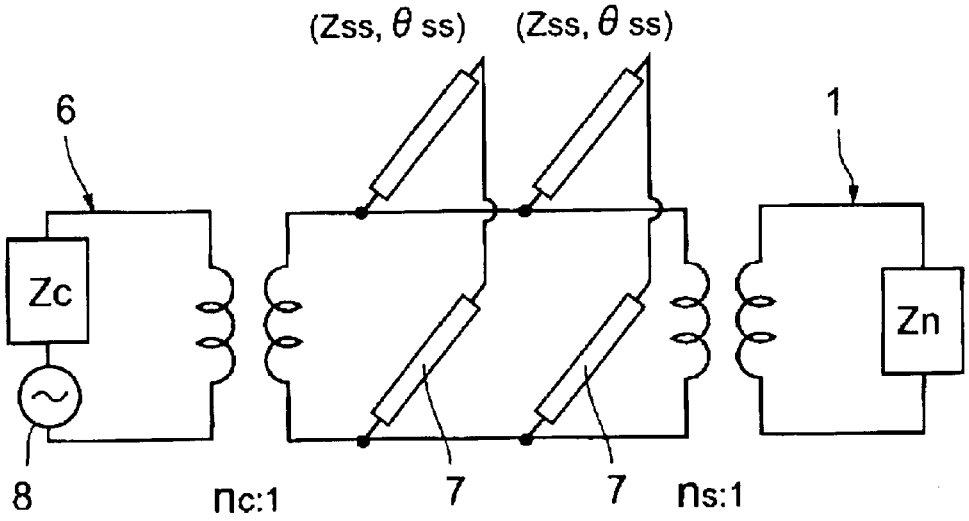
FIG. 5 is an equivalent circuit diagram of the transmission line according to the first embodiment.

A converting system for converting the RF signal in the waveguide of the dielectric substrate 1 into the RF signal in the coplanar line 6 via the slots 7 can be illustrated by an equivalent circuit shown in FIG. 5. In this case, Zn represents the impedance of the waveguide in the dielectric substrate 1, Zc represents the impedance of the coplanar line 6, Zss represents the impedance of a short-circuited stub formed by each slot 7, and θess represents an electrical angle of the short-circuited stub formed by each slot 7. Further, ns represents the mutual inductance between the waveguide in the dielectric substrate 1 and the slots 7, and nc represents the mutual inductance between the coplanar line 6 and the slots 7. FIG. 5 illustrates a case where an oscillator 8 is connected to the coplanar line 6. In this case, the electrical angle θss is changed according to the length L1 for each slot 7.

Figure 6:
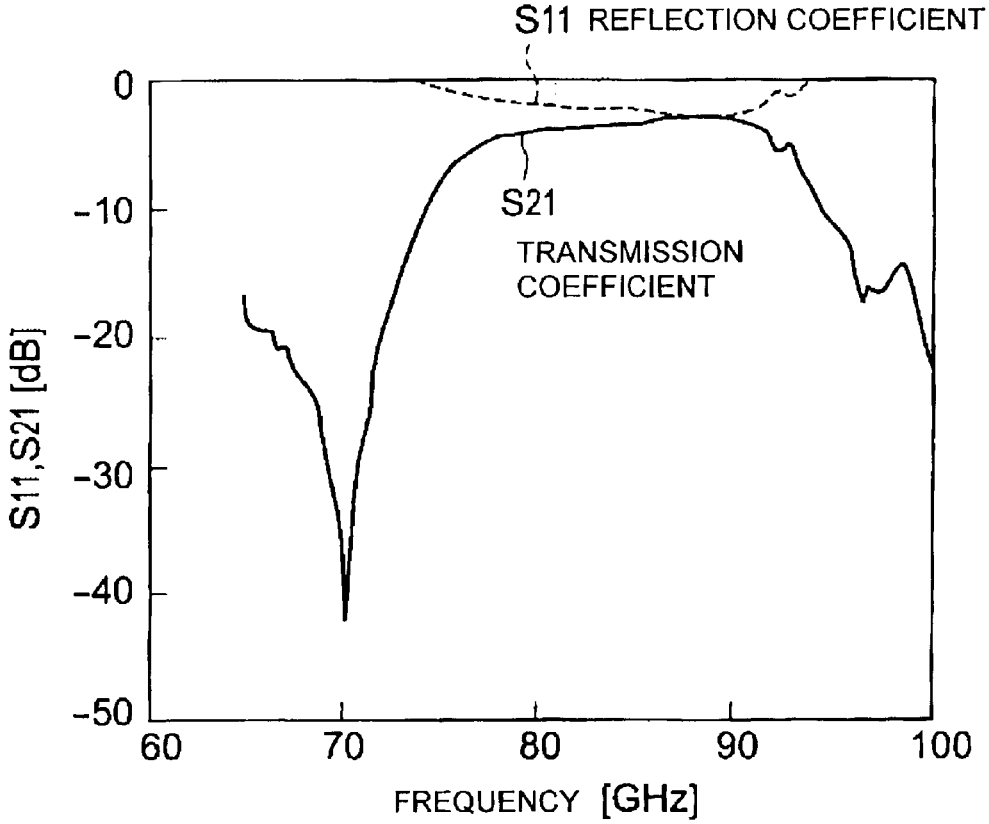
FIG. 6 illustrates characteristic lines showing the relationship between a reflection coefficient, a transmission coefficient, and the frequency of an RF signal obtained in a case where the transmission line in FIG. 1 is used.
Figure 7:
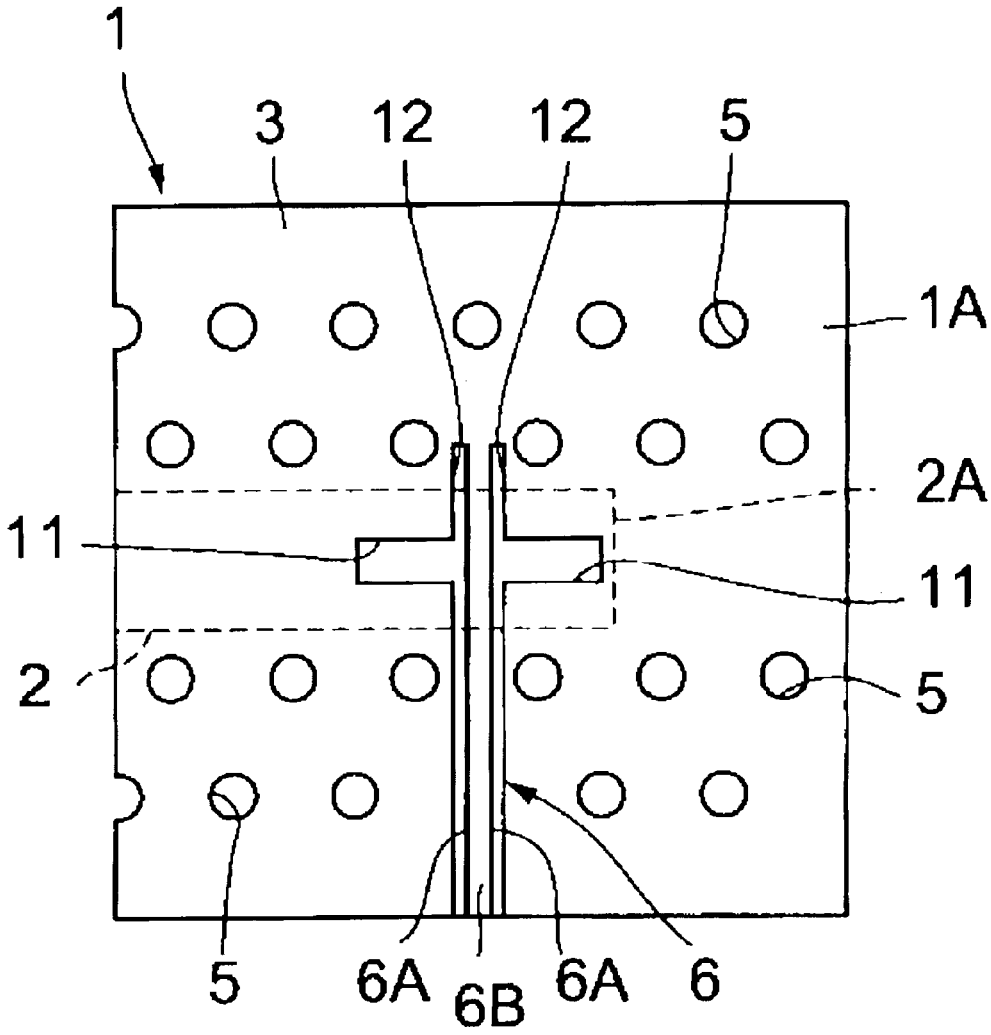
FIG. 7 is a plan view of a transmission line according to a second embodiment.

Therefore, in the case where the transmission line according to the first embodiment is used, by setting the length L1 of each slot 7 or the like as required, it becomes possible to bring the impedance of the overall circuit of the slots 7, including two coils and the two short-circuited stubs, close to the impedance Zn of the waveguide in the dielectric substrate 1 and the impedance Zc of the coplanar line 6. Subsequently, a transmission characteristic shown in FIG. 6, for example, is obtained. As a result, the reflection coefficient S11 and the transmission coefficient S21 between the waveguide in the dielectric substrate 1 and the coplanar line 6 are changed according to the frequency of the RF signal. For example, when the frequency of the RF signal is around 88 GHz, the reflection coefficient S11 is decreased and the transmission coefficient 21 is increased so that they are both at around −3 dB. Therefore, the RF signal can be efficiently converted between the waveguide and the coplanar line 6 with a small loss.

Thus, according to the present embodiment, the coplanar line 6 is formed on the top surface 1A of the dielectric substrate 1. Further, the slots 7 are formed at the top end of the coplanar line 6. The position where the slots 7 are formed corresponds to the position where the projection part 2 is formed. Therefore, the RF signal in the waveguide, which is formed along the projecting part 2, can be guided to the grooves 6A via the slots 7. Further, the RF signal can be efficiently converted between the waveguide and the coplanar line 6.

Further, on the bottom surface 1B of the dielectric substrate 1, the projecting part 2 is provided. As has been described, the projecting part 2 has a protruding cross section and extends in the RF-signal transmission direction. Further, the conductive layer 4 is formed on the bottom surface 1B and the outer surfaces of the projecting part 2. Therefore, it becomes possible to pass a current through the through holes 5 and on the side-surfaces of the projecting part 2. Further, the projecting part 2 is continuously formed along the RF-signal transmission direction. Therefore, it becomes possible to pass a current not only in a direction along the thickness of the dielectric substrate 1 but also in a direction across the thickness of the dielectric substrate 1 at an oblique angle. Therefore, according to the first embodiment, concentrated currents in the through holes 5 are reduced compared to a case where the projecting part 2 is not provided. Further, transmission losses of the entire transmission line, which includes the coplanar line 6, are reduced.

FIGS. 7 to 10 illustrate a transmission line according to a second embodiment of the present invention. According to this embodiment, slots and short-circuited stubs are connected at the top end of a coplanar line. In this embodiment, the same components as those in the first embodiment are designated by the same reference numerals or characters, and the description thereof is omitted.

Figure 8:
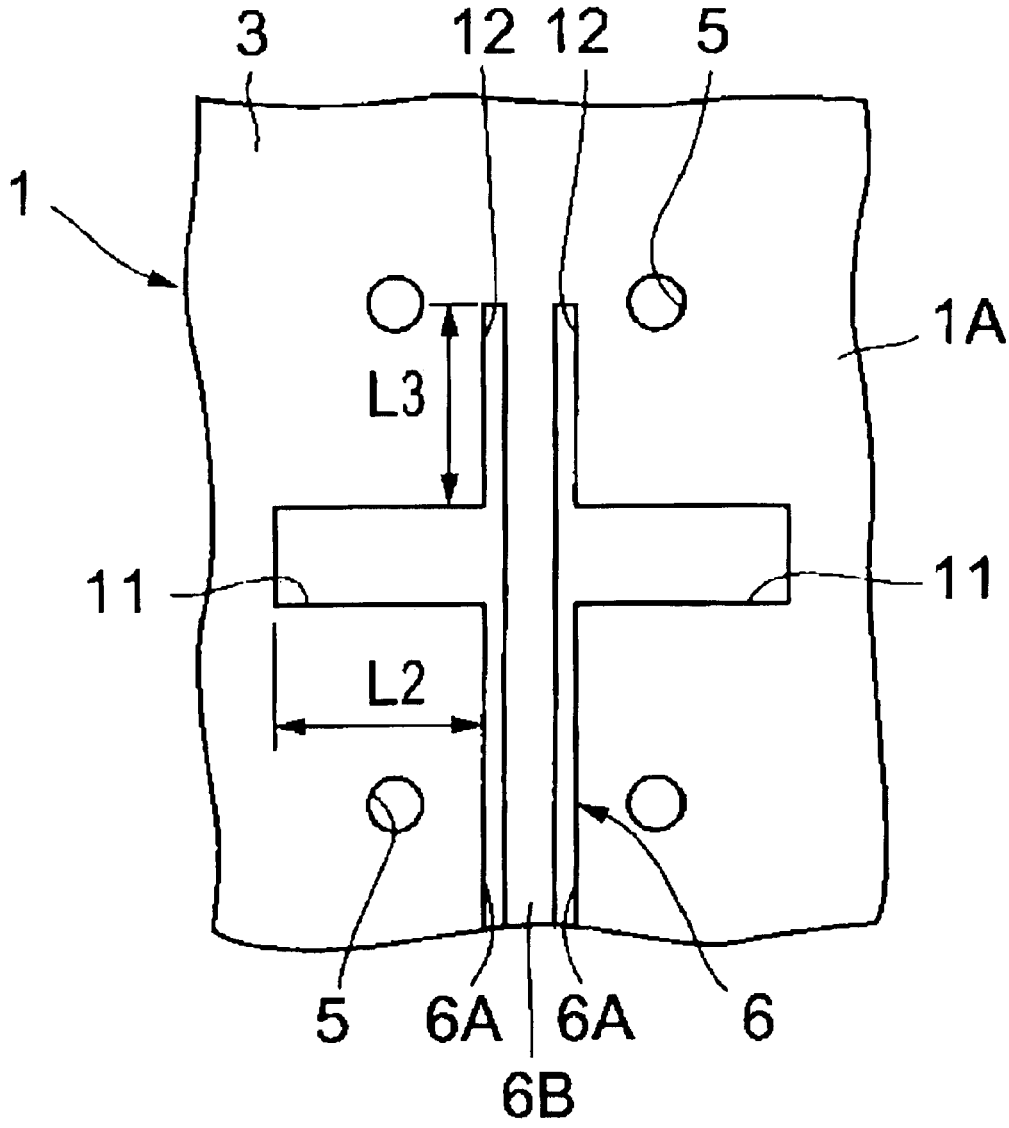
FIG. 8 is an enlarged plan view illustrating the slots and short-circuited stubs, that are shown in FIG. 7.

Reference numerals 11 (FIGS. 7–9) represent two slots formed at the top end of the coplanar line 6. Each of the slots 11 is formed by making an opening in the conductive layer 3, and the base end thereof is connected to one of the grooves 6A of the coplanar line 6. The slots 11 are preferably formed as substantially rectangular-shaped holes extending along the longitudinal direction of the projecting part 2. The length of each slot 7 is represented by L2 (FIG. 8). L2 is preferably set to about $\lambda g/4$ in relation to the wavelength $\lambda g$ of the RF signal in the dielectric substrate 1. Subsequendy, both ends of the slots 11 in the longitudinal direction thereof constitute short-circuited ends, and the base ends thereof constitute open circuited ends. Further, the slots 11 are formed near the short-circuited position (the terminal end 2A) of the projecting part 2.

Reference numerals 12 (FIGS. 7–9) represent two short-circuited stubs that are connected to the top end of the coplanar line 6. The short-circuited stubs 12 are formed by, for example, extending the grooves 6A in a straight line so that each of the extended parts has the same width as that of the grooves 6A. Further, each base end of the short-circuited stubs 12 is connected to each base end of the slots 11. The length of each short-circuited stubs 12 is represented by L3 (FIG. 8). L3 is preferably set to about λg/4 in relation to the wavelength λg of the RF signal in the dielectric substrate 1. Subsequently, the top ends of the short-circuited stubs 12 in the longitudinal direction thereof constitute short-circuited ends, and the base ends thereof constitute opening ends.

Figure 9:
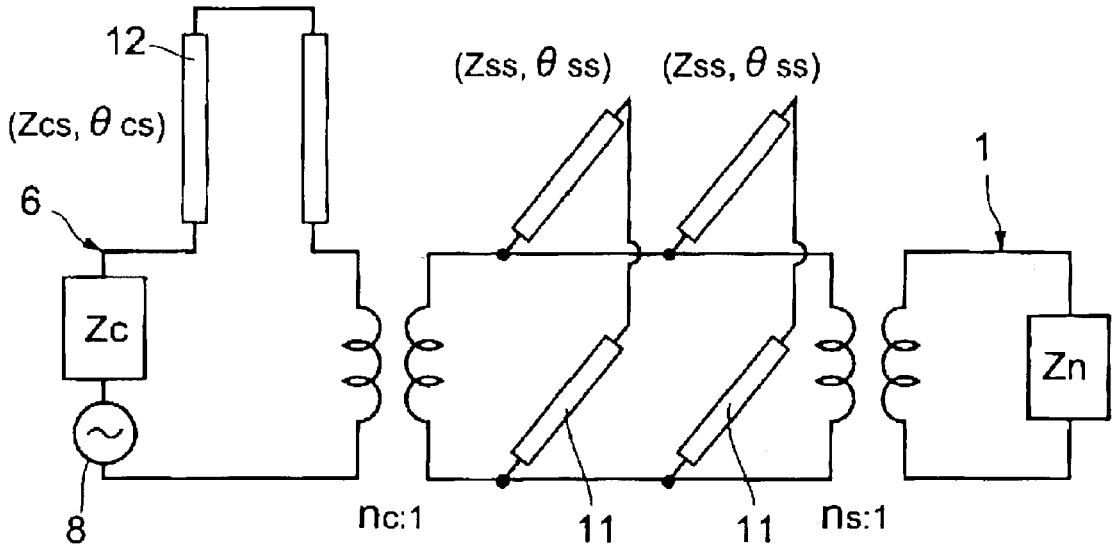
FIG. 9 is an equivalent circuit diagram of the transmission line according to the second embodiment.

A converting system for converting the RF signal in the waveguide of the dielectric substrate 1 into the RF signal in the coplanar line 6 via the slots 11 can be illustrated by an equivalent circuit shown in FIG. 9 as in the case of the equivalent circuit shown in FIG. 5. In FIG. 9, Zcs represents the impedance of the short-circuited stub 12 and θcs represents the electrical angle of the short-circuited stub 12. The electrical angle θss is changed according to the length L2 of each slot 11 and the electrical angle θcs is changed according to the length L3 of the short-circuited stub 12.

Figure 10:
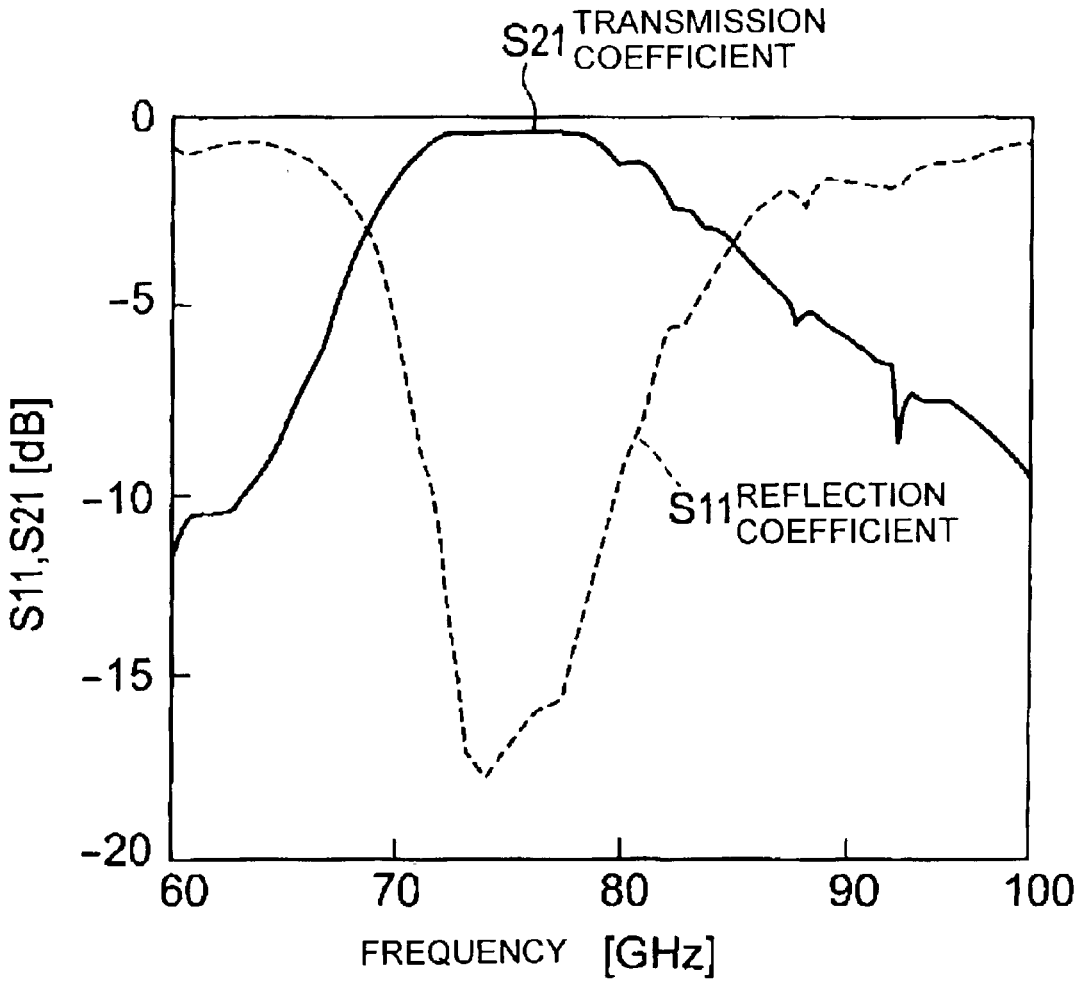
FIG. 10 illustrates characteristic lines showing the relationship between a reflection coefficient, a transmission coefficient, and the frequency of an RF signal obtained in a case where the transmission line in FIG. 7 is used.

Therefore, in the case where the transmission line according to the second embodiment is used, by setting the length L2 of each slot 11, the length L3 of each short-circuited stub 12, and so forth as required, it becomes possible to adjust the impedance of an entire circuit of the slots 11, including two coils and the two short-circuited stubs. Further, by setting the length L3 of each short-circuited stub 12 as required, it becomes possible to adjust the impedance of an overall circuit including the short-circuited stubs 12 and the coplanar line 6. Subsequently, the difference between the impedance of the circuit of the slots-11-side and the impedance of the circuit of the coplaner-line-6-side is reduced. Therefore, the reflection loss between the two circuits is reduced and a transmission characteristic shown in FIG. 10 is obtained.

As a result, when the frequency of the RF signal is about 75 GHz, the reflection coefficient S11 between the waveguide in the dielectric substrate 1 and the coplanar line 6 is reduced so as to be at around −18 dB. Further, the transmission coefficient S21 between the waveguide in the dielectric substrate 1 and the coplanar line 6 is increased so as to be at around to −1 dB. Therefore, compared to a case where the short-circuited stubs 12 are not provided, the RF-signal loss is reduced and the RF signal can be efficiently converted between the waveguide of the dielectric substrate 1 and the coplanar line 6.

Thus, according to the second embodiment of the present invention, an effect similar to that of the first embodiment can be obtained. However, in this embodiment, the slots 11 and the short-circuited stubs 12 are connected to the top end of the coplanar line 6. Therefore, the reflection loss between the slots 11 and the coplanar line 6 can be reduced. Further, RF signals can be efficiently converted between the slots 11 and the coplanar line 6.

Figure 11:
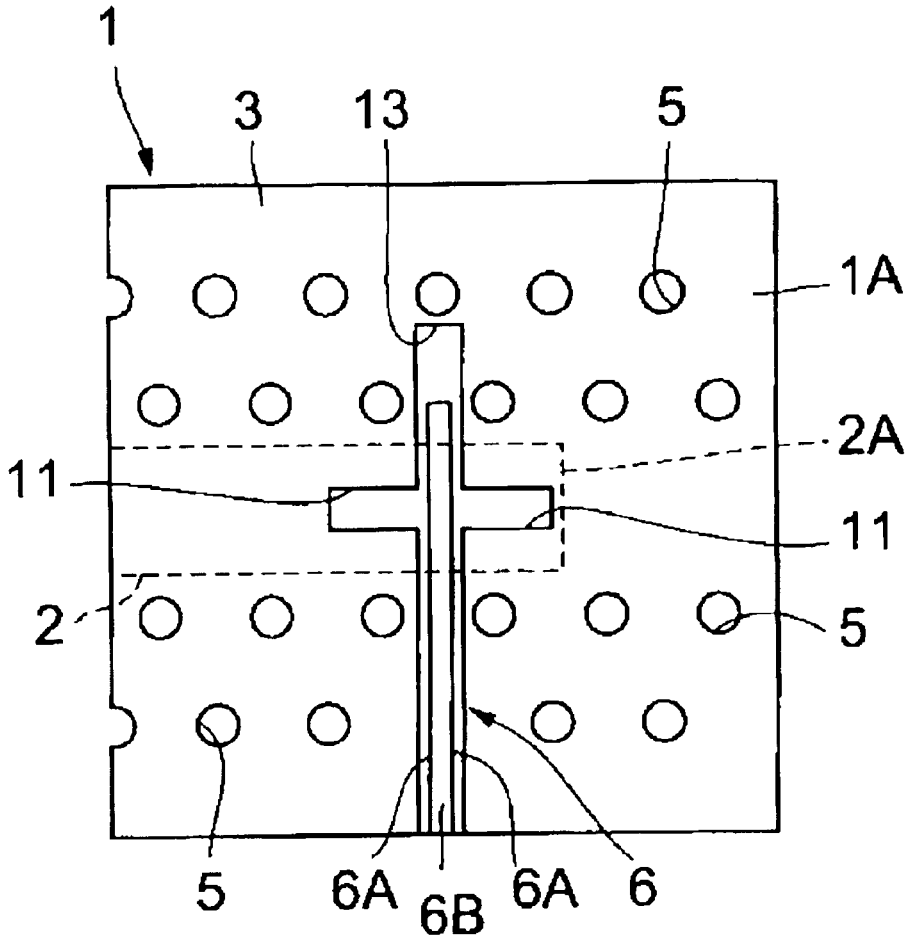
FIG. 11 is a plan view of a transmission line according to a first modification of the present invention.
Figure 12:
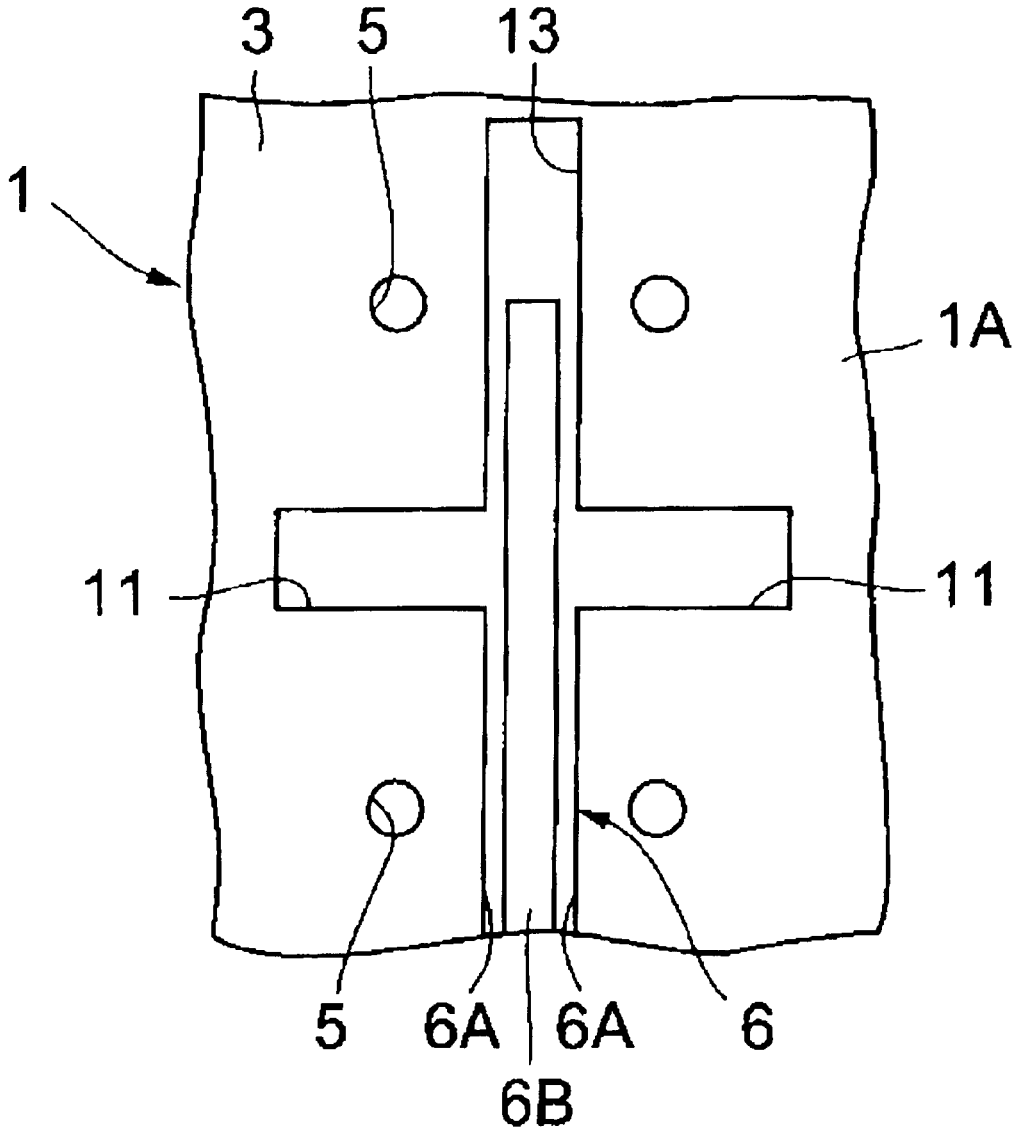
FIG. 12 is an enlarged plan view illustrating the slots and short-circuited stubs shown in FIG. 11.

In the second embodiment, the short-circuited stubs 12 are connected to the top end of the coplanar line 6. However, an open circuit stub 13 may be connected instead of the short-circuited stubs 12 as in a first modification illustrated in FIGS. 11 and 12. In such a case, the opening stub 13 is formed by extending the grooves 6A of the coplanar line 6 in a straight line as in the case of the short-circuited stubs 12. Further, the top ends of the extended grooves 6A are joined so that the joined top ends substantially form a U-shape. In the case of such a modification, a similar effect as that of the second embodiment can be obtained by changing the length of the opening stub 13 as required.

Figure 13:
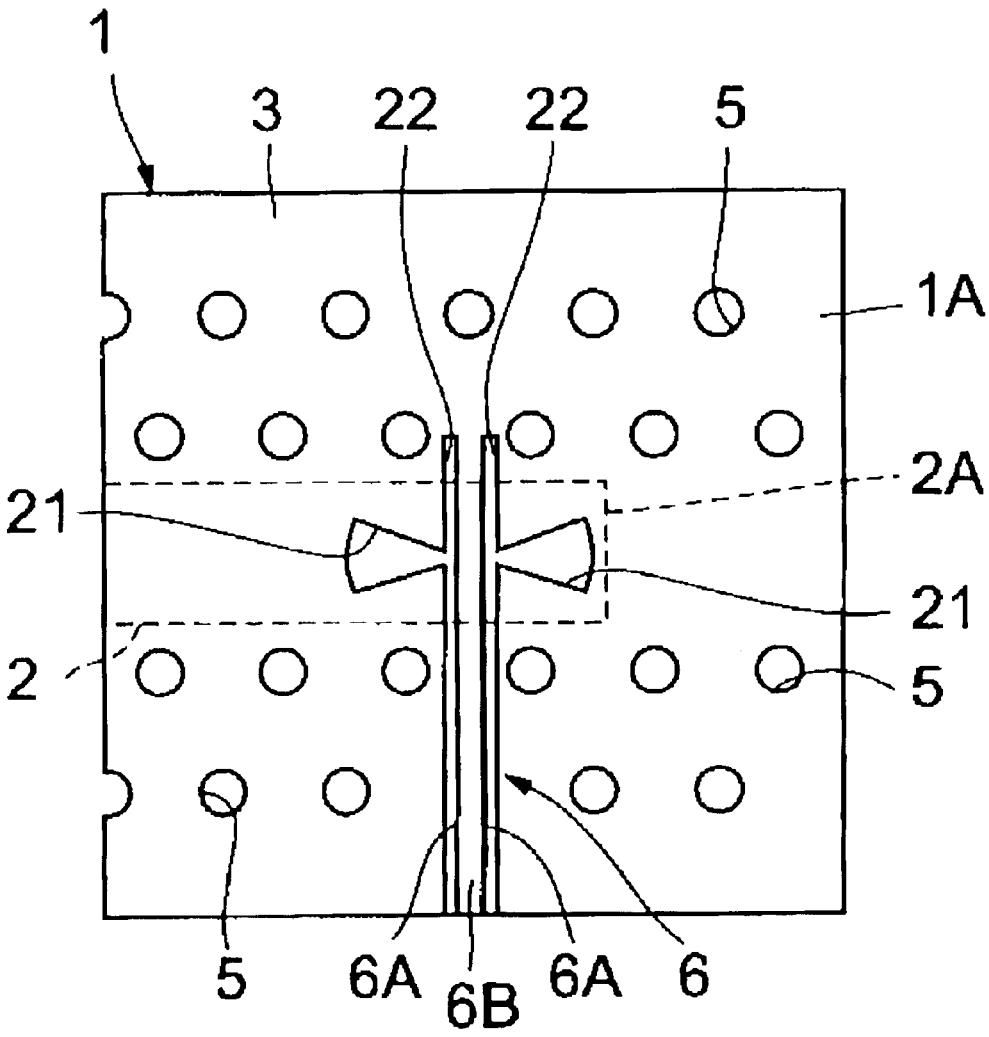
FIG. 13 is a plan view of a transmission line according to a third embodiment.
Figure 14:
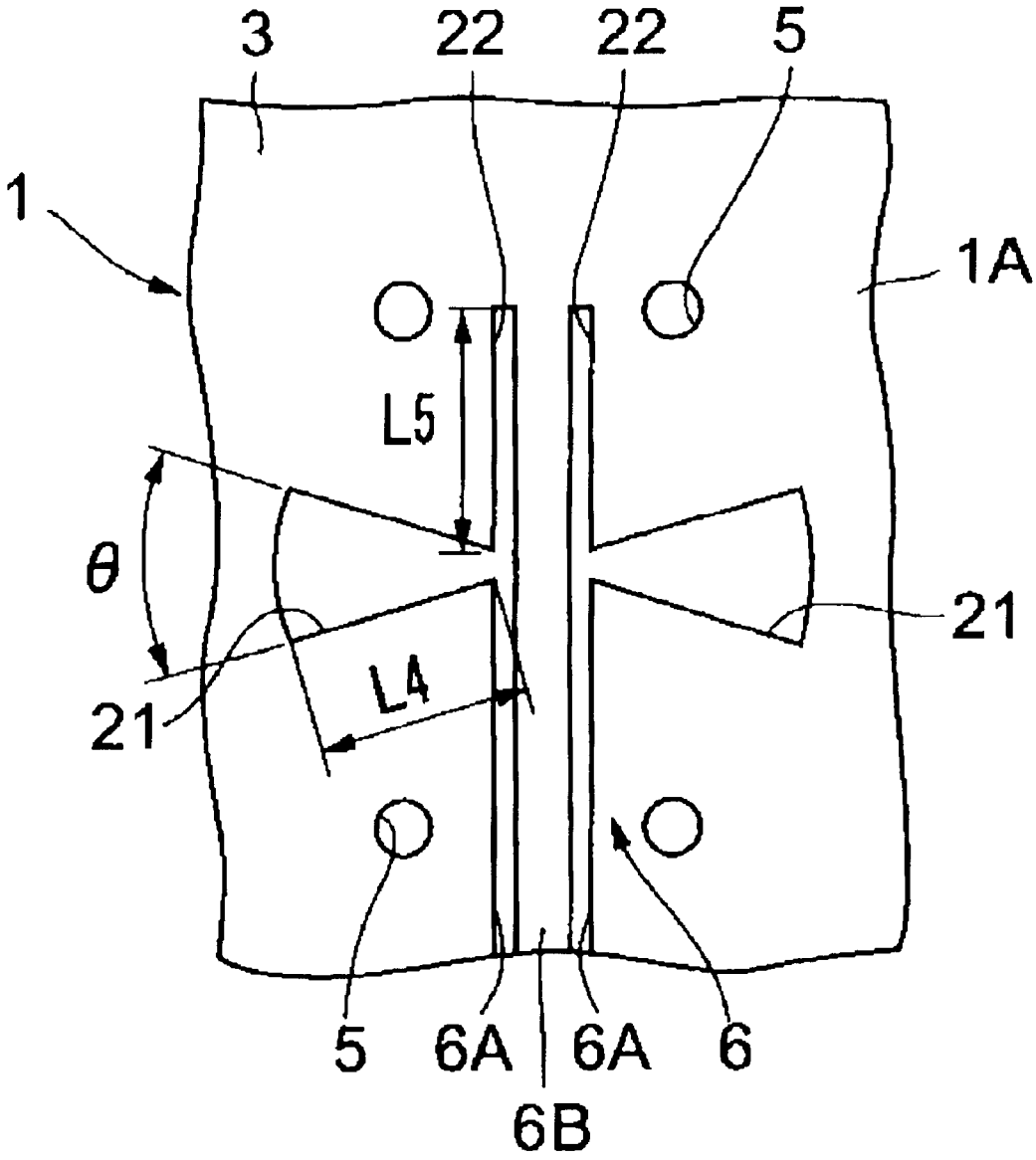
FIG. 14 is an enlarged plan view illustrating the slots and short-circuited stubs shown in FIG. 13.
Figure 15:
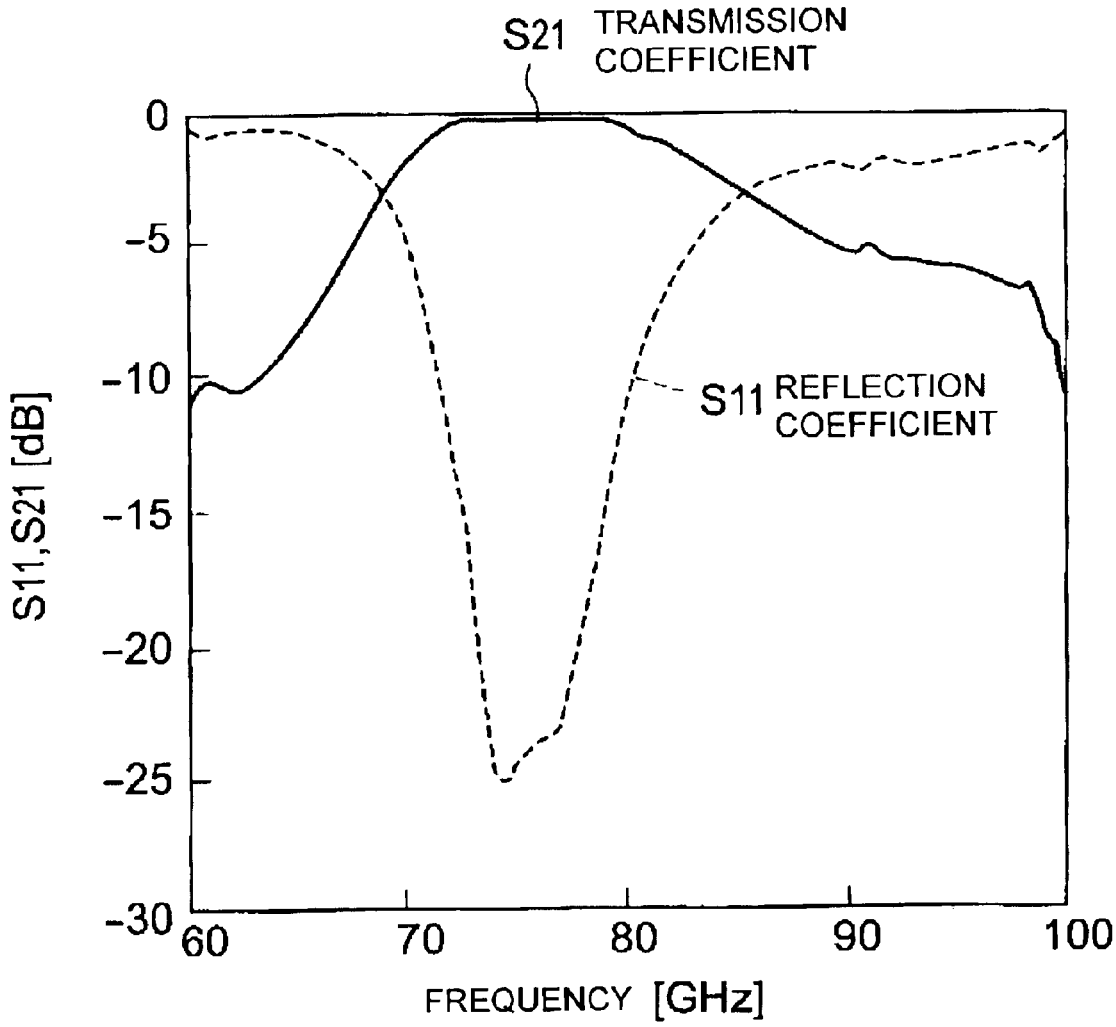
FIG. 15 illustrates characteristic lines showing the relationship between a reflection coefficient, a transmission coefficient, and the frequency of an RF signal obtained in a case where the transmission line in FIG. 13 is used.

FIGS. 13 to 15 illustrate a transmission line according to a third embodiment of the present invention. The transmission line according to the third embodiment includes two fan-shaped slots. In this embodiment, the same components as those in the first embodiment are designated by the same reference numerals or characters, and the description of such components is omitted.

Reference numerals 21 (FIGS. 13, 14) represent two slots. Each of the slots 21 is formed by making an opening in the conductive layer 3 at the top end of the coplanar line 6. The base ends of the slots 21 are connected to the grooves 6A of the coplanar line 6. The slots 21 are preferably fan-shaped such that they gradually spread at an angle θ (FIG. 14) from the base-end to the top end. The length of each slot 21 is represented by L4 (FIG. 14). L4 is preferably set to about λg/4 in relation to the wavelength λg of the RF signal in the dielectric substrate 1. Subsequently, the top ends of the slots 21 constitute short-circuited ends, and the base ends thereof constitute opening ends. Further, the slots 21 are formed near the short-circuited position (the terminal end 2A) of the projecting part 2.

Reference numerals 22 (FIGS. 13, 14) represent two short-circuited stubs connected to the top end of the coplanar line 6. The short-circuited stubs 22 are formed by, for example, extending the grooves 6A in a straight line so that each of the extended parts has the same width as that of the groove 6A. Further, each base end of the short-circuited stubs 22 is connected to each base end of the slots 21. The length of each short-circuited stubs 22 is represented by L5 (FIG. 14). L5 is preferably set to about λg/4 in relation to the wavelength λg of the RF signal in the dielectric substrate 1. Subsequently, the top ends of the short-circuited stubs 22 in the longitudinal direction thereof constitute short-circuited ends, and the base ends thereof constitute open circuited ends.

In the configuration of the transmission line according to the third embodiment, the converting system between the waveguide of the dielectric substrate 1 and the coplanar line 6 can be illustrated by the same equivalent circuit as that of the second embodiment (refer to FIG. 9). Further, according to this embodiment, the impedances of the short-circuited stubs 22, which are generated by the slots 21, can be changed according to the spreading angle θ of the slots 21.

Accordingly, in a case where the transmission line of the third embodiment is used, the impedance of an entire circuit of the slots 21, including two coils and the two short-circuited stubs, can be adjusted by changing the length L5 of the short-circuited stubs 22, the length L4 of the slots 21, the angle θ, and so forth. Further, the impedance of an entire circuit including the short-circuited stubs 22 and the coplanar line 6 can be adjusted by changing the length L5 of the short-circuited stubs 22 as required. Subsequently, the difference between the impedance of the circuit on the slots-21-side and the impedance of the circuit on the coplanar-line-6-side can be further reduced. Further, reflection losses due to wide-band RF signals can be reduced. Therefore, a transmission characteristic such as that shown in FIG. 15 can be achieved.

As a result, when the frequency of the RF signal is about 72 to 82 GHz, the reflection coefficient S11 between the waveguide in the dielectric substrate 1 and the coplanar line 6 is reduced so as to be at around −10 to −25 dB. Further, the transmission coefficient S21 between the waveguide in the dielectric substrate 1 and the coplanar line 6 is increased so as to be at around −0.2 dB. Therefore, the RF-signal loss can be reduced over a bandwidth of about 10 GHz and the RF signal can be efficiently converted between the waveguide of the dielectric substrate 1 and the coplanar line 6.

Thus, according to the third embodiment of the present invention, an effect similar to that of the first embodiment can be obtained. In this embodiment, however, since the fan-shaped slots 21 and the short-circuited stubs 22 are connected to the top end of the coplanar line 6, the reflection loss between the slots 21 and the coplanar line 6 can be reduced. Further, the RF signal can be efficiently converted between the slots 11 and the coplanar line 6.

According to the third embodiment, only the slots 21 are fan-shaped. However, the short-circuited stubs 22 may also be fan-shaped.

Figure 16:
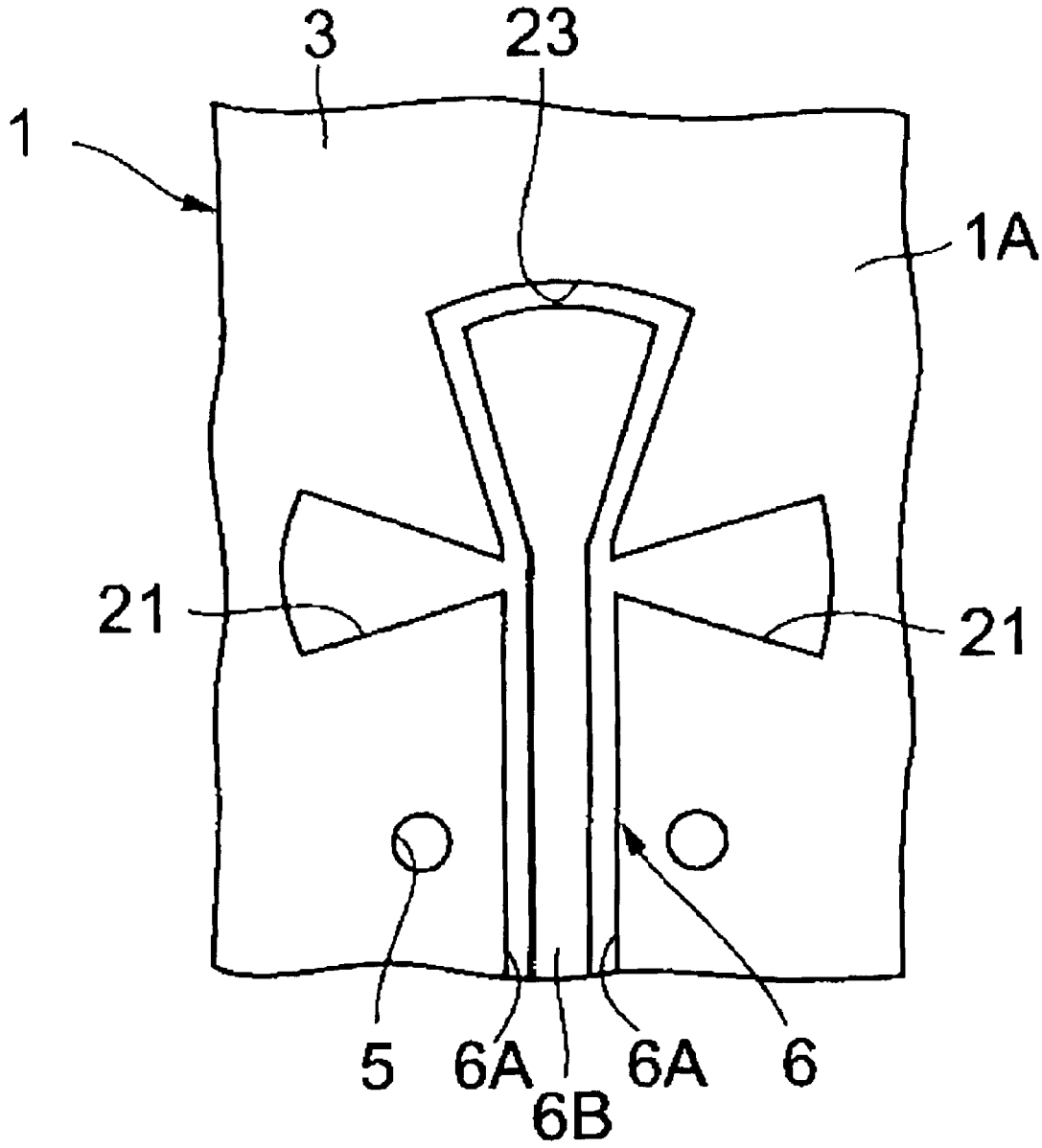
FIG. 16 is an enlarged plan view illustrating slots and an open circuit stub according to a second modification of the present invention.
Figure 17:
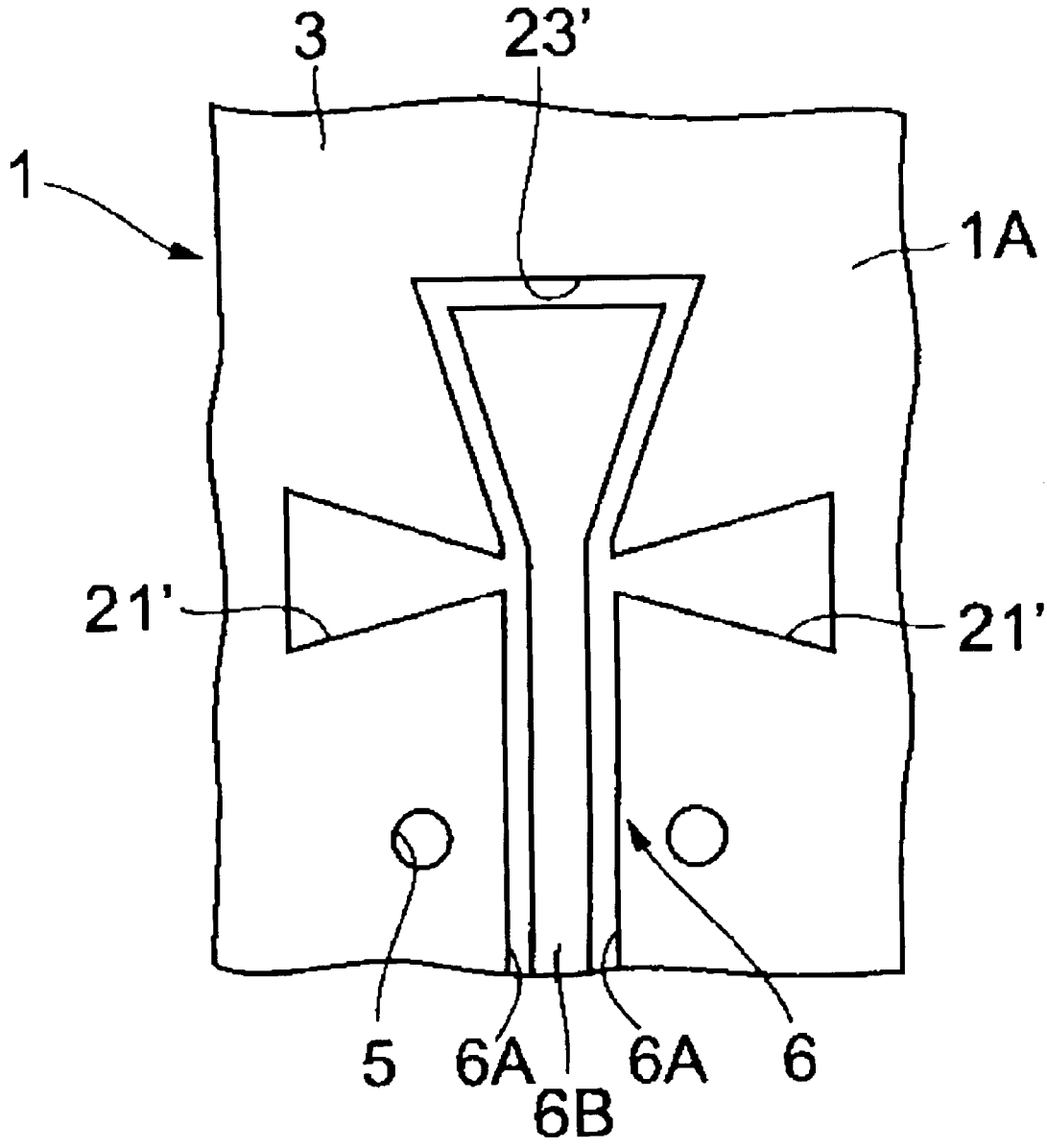
FIG. 17 is an enlarged plan view illustrating slots and an open circuit stub according to a third modification of the present invention.

In a second modification shown in FIG. 16, a fan-shaped open circuited stub 23 instead of the short-circuited stubs 22 may be connected to the top end of the coplanar line 6. In this modification, the top ends of the slots 21 and the open circuited stub 23 are arc-shaped. However, slots 21' and an open circuited stub 23', as in a third modification shown in FIG. 17, may be provided. As shown in FIG. 17, the top ends of the slots 21' and the opening stub 23' are linear.

Figure 18:
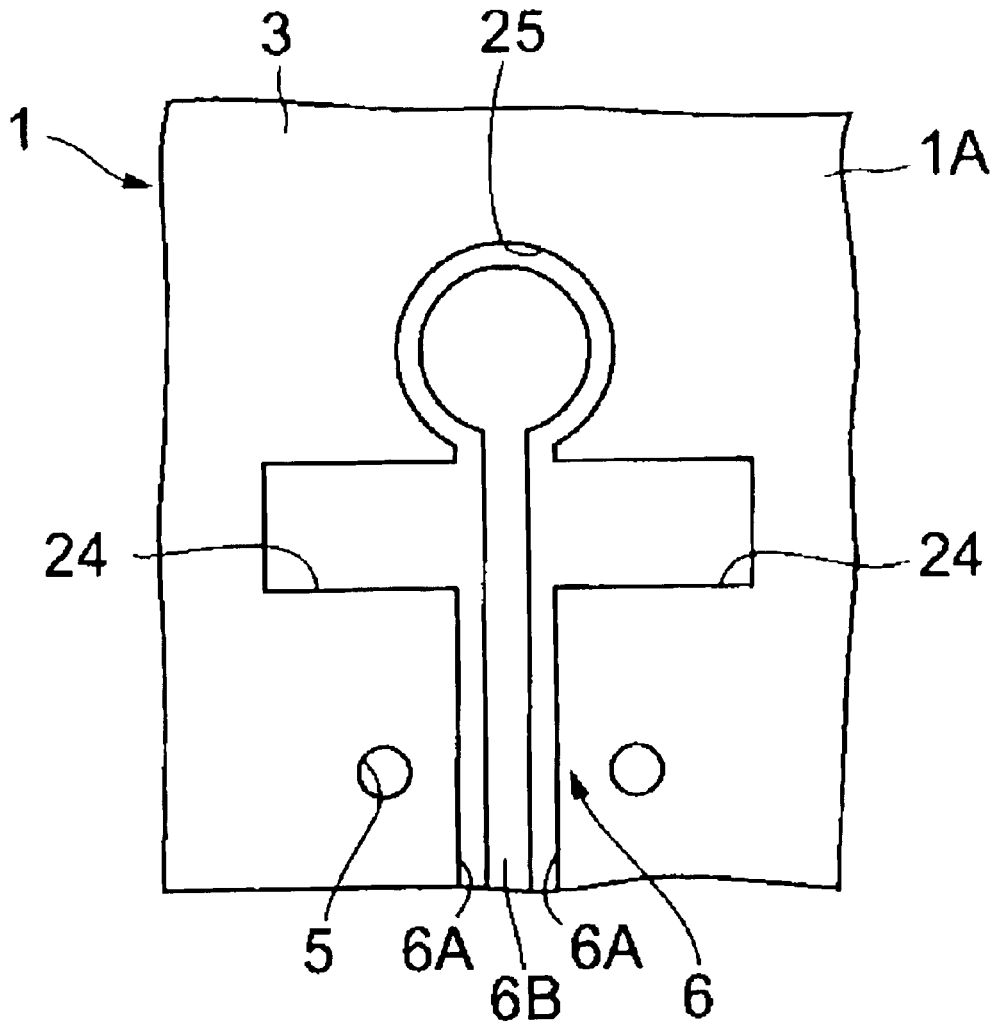
FIG. 18 is an enlarged plan view illustrating slots and an open circuit stub according to a fourth modification of the present invention.
Figure 19:
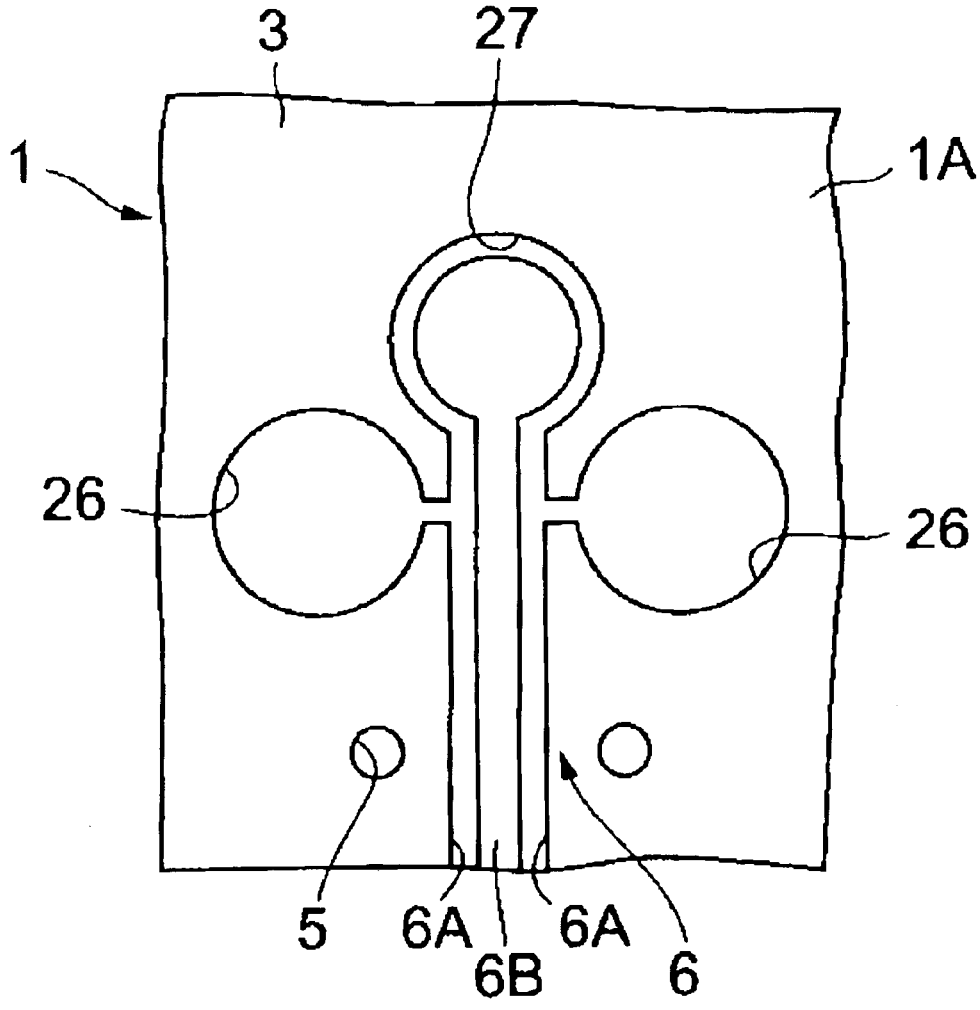
FIG. 19 is an enlarged plan view illustrating slots and an open circuit stub according to a fifth modification of the present invention.

Alternatively, as in a fourth modification shown in FIG. 18, substantially square-shaped slots 24 and a substantially circular-shaped open circuited stub 25 may be connected to the top end of the coplanar line 6. On the other hand, two substantially circular-shaped slots 26 and a substantially circular-shaped open circuited stub 27 may be connected to the top end of the coplanar line 6 as in a fifth modification shown in FIG. 19. The above-described slots and stubs may be used in various combinations. In such a case, the same effect as that of the third embodiment can be obtained.

Figure 20:
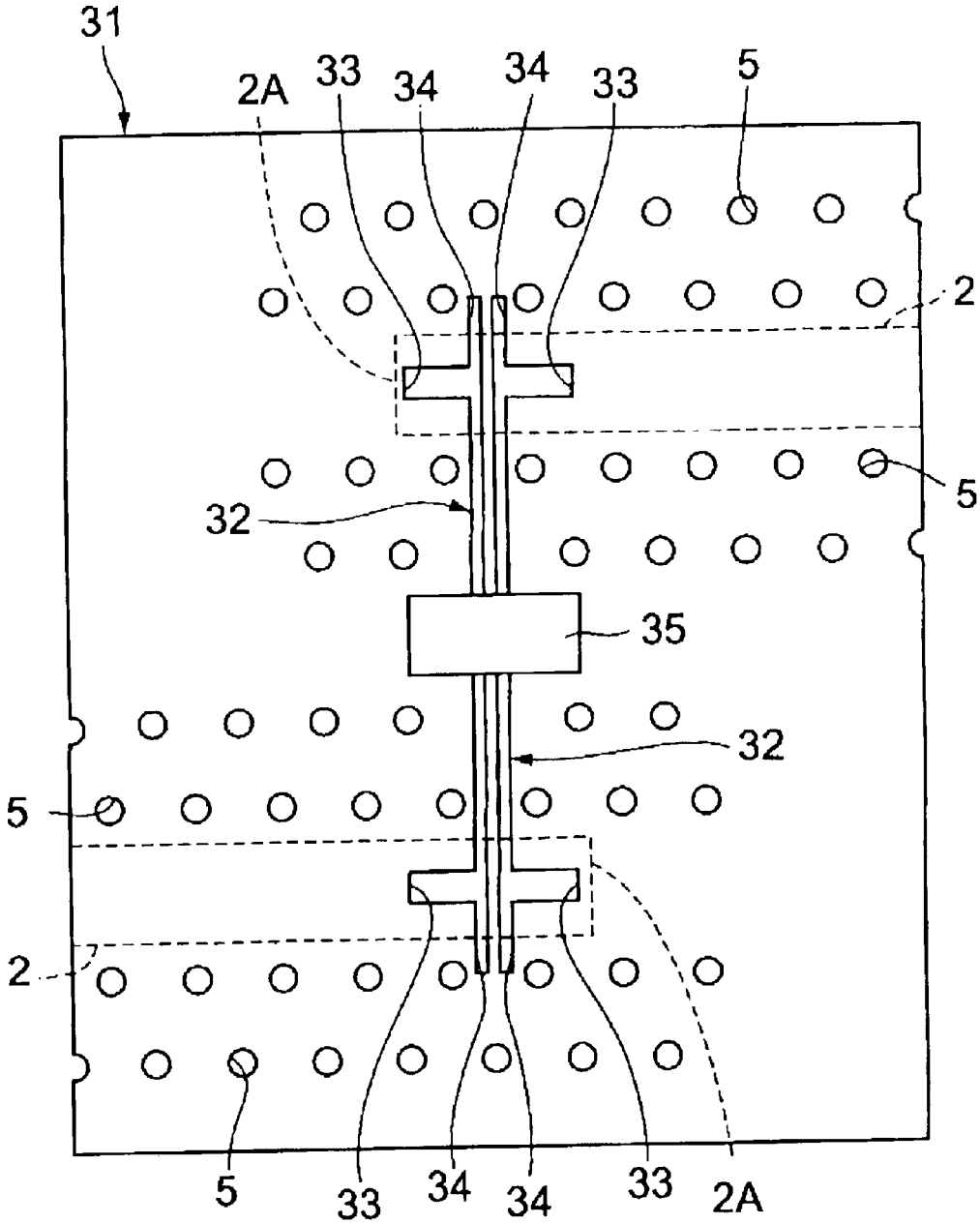
FIG. 20 is a plan view of a transmission line according to a fourth embodiment.

FIG. 20 illustrates a fourth embodiment of the present invention. According to the fourth embodiment, a semiconductor element that is connected to a coplanar line is mounted on the top surface of a dielectric substrate. In this embodiment, it should be noted that the same elements as those in the first embodiment are designated by the same reference numerals and characters, and the description thereof is omitted.

Reference numeral 31 represents a dielectric substrate according to the fourth embodiment. On the dielectric substrate 31, a first and a second projecting parts 2 extending in parallel to each other are formed. Reference numerals 2A represent a first and a second terminal ends of the two projecting parts 2. The first and second terminal ends 2A of the projecting parts 2 are positioned near the center of the dielectric substrate 31. The top surface of the dielectric substrate 31 is covered by the conductive layer 3. The bottom surface of the dielectric substrate 31 is also covered by a conductive layer (not shown). Further, many through holes 5 are formed along the two projecting parts 2 on the dielectric substrate 31.

Reference numerals 32 represent a first and a second coplanar lines formed on the top surface of the dielectric substrate 31. The two coplanar lines 32 extend between the two projecting parts 2. The base ends of the two coplanar lines 32 are placed near the center of the dielectric substrate 31. The top ends of the two coplanar lines 32 are placed near the terminal ends 2A of the projecting parts 2. To the top end of the first coplanar line 32, a first pair of slots 33 and a first pair of short-circuited stubs 34 are connected. The position of the first slots 33 corresponds to that of the first projecting part 2. Further, to the top end of the second coplanar line 32, a second pair of slots 33 and a second pair of short-circuited stubs 34 are connected. The position of the second slots 33 corresponds to that of the second projecting part 2.

Reference numeral 35 represents a semiconductor element such as an MMIC that is mounted on the top surface of the dielectric substrate 31. The semiconductor element 35 is placed between the first and second coplanar lines 32 and is connected to each base end of the first and second coplanar lines 32.

Thus, according to the fourth embodiment, the same effect as that of the first embodiment can be achieved. Further, according to this embodiment, the first and second coplanar lines 32 are connected to the semiconductor element 35, which is provided on the top surface of the dielectric substrate 31. Therefore, the process of mounting the semiconductor element 35 becomes easy.

Figure 21:
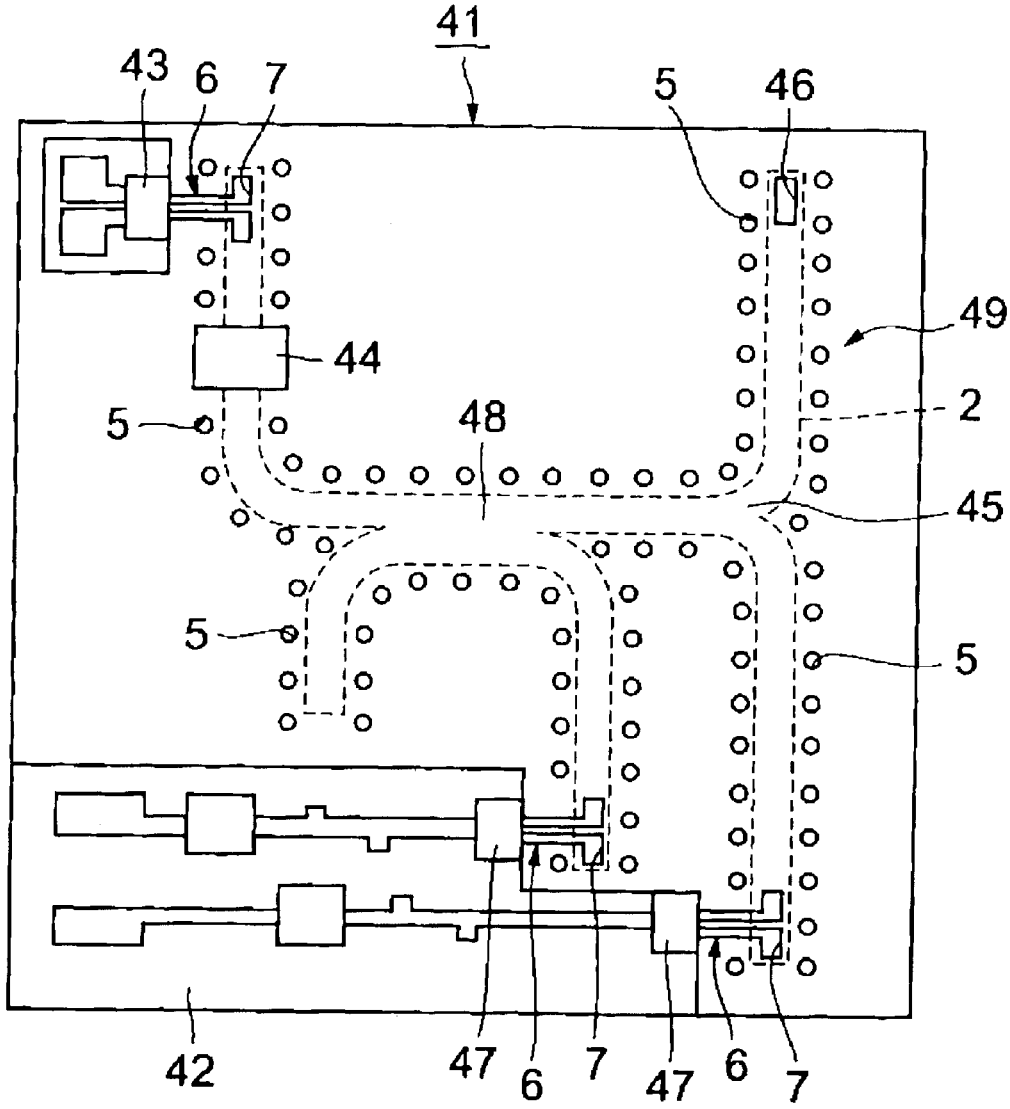
FIG. 21 is a plan view of a radar system according to an aspect of the present invention.
Figure 22:
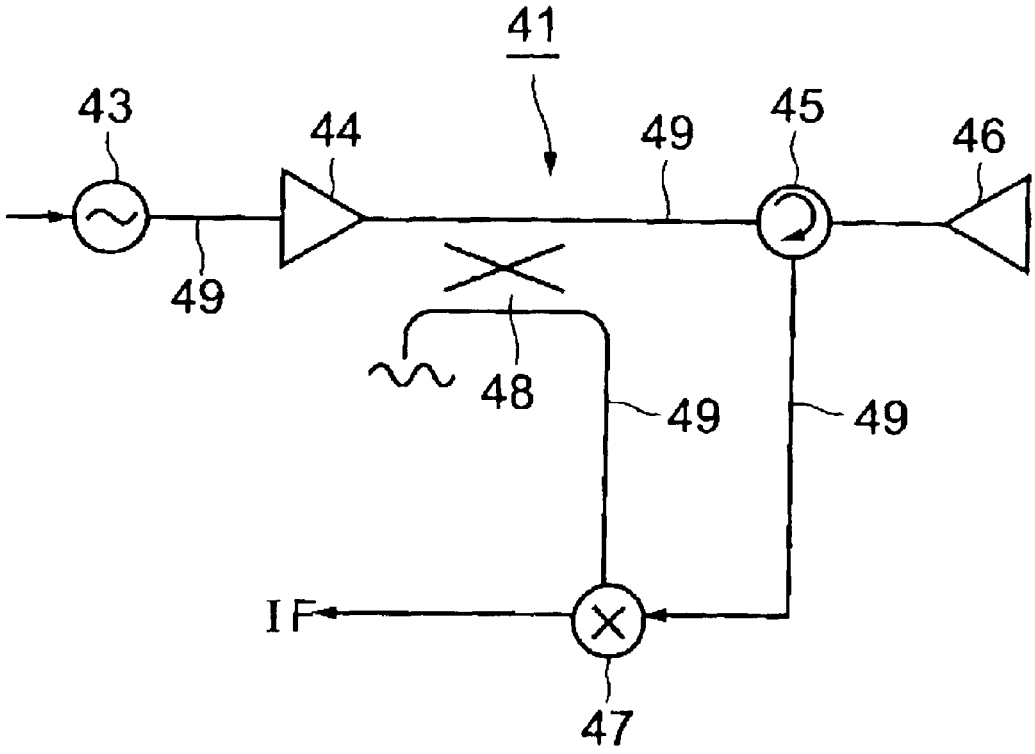
FIG. 22 is a block diagram of the radar system of FIG. 21.

FIGS. 21 and 22 illustrate a radar system formed by the transmission line of the present invention.

Reference numeral 41 represents a radar system that is formed as a transceiver according to the present invention. The radar system 41 includes a dielectric substrate 42 having the conductive layer 2 formed on both surfaces thereof. Of these conductive layers 8, only the one which is formed on the top surface is shown in FIG. 21. The radar system 41 further includes a voltage-controlled oscillator 43 on the top surface of the dielectric substrate 42, an opening 46 that is connected to the voltage-controlled oscillator 43 via an amplifier 44 and a circulator 45, and a first and a second mixers 47 that are connected to the circulator 45 for down-converting a signal transmitted from the opening 46 to an IF signal. Further, a directional coupler 48 is provided between the amplifier 44 and the circulator 45. The input signal is divided by the directional coupler 48 and the divided signals are input to the mixers 47 as local oscillator signals.

A waveguide 49 extends between the above-described voltage-controlled oscillator 43, the amplifier 44, the circulator 45, the mixers 47, and so forth. The waveguide 49 is formed by a projecting part 2 that is formed on the bottom surface of the dielectric substrate 42 and a plurality of through holes 5 that are formed along the projecting part 2 as in the first to third embodiments. The waveguide 49, the voltage-controlled oscillator 43, and the mixers 47 are interconnected by a first and a second coplanar lines 6, a first pair of slots 7, a second pair of slots 7, and a third pair of slots 7. Thus, the radar system 41 is formed on the dielectric substrate 42.

An oscillation signal that is output from the voltage-controlled oscillator 43 is amplified by the amplifier 44 and is transmitted from the opening 46 as a transmission signal via the directional coupler 48 and the circulator 45. On the other hand, a signal transmitted from the opening 46 is input to the mixers 47 via the circulator 45. Further, the signal is downconverted by the local signals, which are generated by the directional coupler 48, and is output as an IF signal (FIG. 22).

Thus, the waveguide 49, which is formed by the projecting part 2 and the through holes 5, is provided in the dielectric substrate 42 (FIG. 21). Further, the waveguide 49, the voltage-controlled oscillator 43, and the mixers 47 are interconnected by the coplanar lines 6 and the slots 7 with a small loss (FIG. 21). Accordingly, the power efficiency of the radar system is increased and the power consumption thereof is reduced.

Even though the transmission line of the present invention has been described for use in a radar system, the transmission line can also be used for a communication apparatus or the like as a transceiver.

According to the first to fourth embodiments, the two rows of through holes 5 are formed on both sides of the projecting part 2, which is formed on the dielectric substrate 1. That is to say, the four rows of through holes 5 are formed on the dielectric substrate 1. However, one row of through holes 5 may be formed on both sides of the projecting part 2 as in the case of the radar system. That is to say, two rows of through holes 5 may be provided. Alternately, three or more rows of through holes 5 may be formed on both sides of the projecting part 2. That is to say, six or more rows of through holes 5 may be provided.

Further, according to the first to fourth embodiments, the through holes 5 near the projecting part 2 and the through holes 5 far from the projecting part 2 are formed in a staggered arrangement. However, the through holes 5 may be formed, for example, in parallel with one another.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A transmission line comprising:

a dielectric substrate having a top surface and a bottom surface;

a projecting part that protrudes from the bottom surface of the dielectric substrate and extends along an RF-signal transmission direction of the transmission line;

a first conductive layer disposed on the top surface of the dielectric substrate;

a second conductive layer disposed on the bottom surface of the dielectric substrate including outer surfaces of the projecting part;

a plurality of through holes disposed in the dielectric substrate and positioned on either side of the projecting part, the through holes connecting the first and second conductive layers;

a coplanar line disposed in the first conductive layer on the top surface of the dielectric substrate; and at least two slots disposed in the first conductive layer and positioned so as to correspond to the projecting part, each of the at least two slots connected to the coplanar line.

2. The transmission line according to claim 1, wherein the coplanar line comprises two grooves disposed in the first conductive layer and a center electrode located between the two grooves.

3. The transmission line according to claim 1, further comprising a stub which branches off and extends from the coplanar line.

4. The transmission line according to claim 3, wherein the stub is one of an open-circuited stub and a short circuited stub.

5. The transmission line according to claim 3, wherein the stub is fan-shaped.

6. The transmission line according to claim 3, wherein the stub is circular shaped.

7. The transmission line according to claim 3, wherein a length of the stub is about $\lambda g/4$ relative to a wavelength $\lambda g$ of the RF signal.

8. The transmission line according to claim 1, wherein the slots are circular shaped.

9. The transmission line according to claim 1, further comprising a semiconductor element located on the top surface of the dielectric substrate, the semiconductor element being coupled to the coplanar line.

10. The transmission line according to claim 1, wherein a lateral width of the projecting part is smaller than about $\lambda g/2$ relative to a wavelength $\lambda g$ of the RF signal.

11. The transmission line according to claim 1, wherein the projecting part includes a terminal end that is covered by the second conductive layer to provide a short-circuited end.

12. The transmission line according to claim 11, wherein the terminal end is provided near the center of the dielectric substrate.

13. The transmission line according to claim 1, wherein the plurality of through holes are divided into a first plurality of through holes located on a first side of the projecting part, and a second plurality of through holes located on a second side of the projecting part, the first plurality of through holes arranged as two rows, and the second plurality of through holes arranged as two rows.

14. The transmission line according to claim 13, wherein the two rows of the first plurality of through holes are staggered relative to each other, and the two rows of the second plurality of through holes are staggered relative to each other.

15. The transmission line according to claim 1, wherein a spacing between the plurality of through holes is smaller than about $\lambda g/4$ relative to a wavelength $\lambda g$ of the RF signal.

16. The transmission line according to claim 1, wherein a length of the at least two slots is about $\lambda g/2$ relative to a wavelength $\lambda g$ of the RF signal.

17. The transmission line according to claim 1, wherein a length of the at least two slots is about $\lambda g/4$ relative to a wavelength $\lambda g$ of the RF signal.

18. The transmission line according to claim 1, wherein the slots are fan-shaped.

19. A transmission line comprising:

a dielectric substrate having a top surface and a bottom surface;

a first projecting part that protrudes from the bottom surface of the dielectric substrate and extends along an RF-signal transmission direction of the transmission line;

a second projecting part that protrudes from the bottom surface of the dielectric substrate and extends along the RF-signal transmission direction of the transmission line;

a first conductive layer disposed on the top surface of the dielectric substrate;

a second conductive layer disposed on the bottom surface of the dielectric substrate including outer surfaces of the first projecting part and outer surfaces of the second projecting part;

a first plurality of through holes disposed in the dielectric substrate and positioned on either side of the first projecting part, the first plurality of through holes connecting the first and second conductive layers;

a second plurality of through holes disposed in the dielectric substrate and positioned on either side of the second projecting part, the second plurality of through holes connecting the first and second conductive layers;

a first coplanar line disposed in the first conductive layer on the top surface of the dielectric substrate and coupled to the first projecting part;

a second coplanar line disposed in the first conductive layer on the top surface of the dielectric substrate and coupled to the second projecting part;

a first set of at least two slots disposed in the first conductive layer and positioned so as to correspond to the first projecting part, the first set of at least two slots being connected to the first coplanar line;

a second set of at least two slots disposed in the first conductive layer and positioned so as to correspond to the second projecting part, the second set of at least two slots being connected to the second coplanar line; and a semiconductor element located on the top surface of the dielectric substrate, the semiconductor element being coupled to the first coplanar line and the second coplanar line.

20. The transmission line according to claim 19, further comprising:

a first stub which branches off and extends from the first coplanar line; and a second stub which branches off and extends from the second coplanar line.

* * * * *